US005358226A

United States Patent [19]

Arikita

[11] Patent Number: 5,358,226

[45] Date of Patent: Oct. 25, 1994

[54] BRUSH MOUNTING STRUCTURE FOR A CUTTING SUPPORT SURFACE IN AN AUTOMATIC CUTTING MACHINE

[75] Inventor: Reiji Arikita, Wakayama, Japan

[73] Assignee: Shima Seiki Mfg., Ltd., Wakayama, Japan

[21] Appl. No.: 156,608

[22] Filed: Nov. 22, 1993

Related U.S. Application Data

[63] Continuation of Ser. No. 941,016, Sep. 4, 1992, abandoned.

[30] Foreign Application Priority Data

Sep. 6, 1991 [JP] Japan ..... 3-227388

[51] Int. Cl.[5] ..... B26D 7/20

[52] U.S. Cl. ..... 269/21; 269/311; 83/451; 83/658; 83/941

[58] Field of Search ..... 83/451, 658, 941; 269/21, 289 R, 311, 309; 198/689.1

[56] References Cited

U.S. PATENT DOCUMENTS

| | | | |
|---|---|---|---|
| 4,205,835 | 6/1980 | Gerber | 83/451 X |
| 4,528,878 | 7/1985 | Gerber | 83/451 X |
| 4,730,526 | 3/1988 | Pearl et al. | 198/689.1 X |
| 5,001,954 | 3/1991 | Andràda Galan et al. | 83/451 |

*Primary Examiner*—Rinaldi I. Rada

*Attorney, Agent, or Firm*—Edwin E. Greigg; Ronald E. Greigg

[57] ABSTRACT

A brush mounting structure for a cutting support surface in an automatic cutting machine capable of dismounting a desired damaged brush out of plural brushes mounted on the cutting surface and disposed in parallel on the brush mounting table. The invention comprehends allowing one to replace the removed brush with a new brush, or alternatively, to fill the gap caused by removal of a damaged brush on the brush mounting table by sliding the remaining brushes together and placing the new brush on the end of the existing brush group. In that way, the worn bristles of the used brushes are maintained at a more uniform operational height than were a new brush with longer bristles interposed therebetween.

6 Claims, 8 Drawing Sheets

BRUSH MOUNTING STRUCTURE FOR A CUTTING SUPPORT SURFACE IN AN AUTOMATIC CUTTING MACHINE

This is a continuation of copending application(s) Ser. No. 07/941,016 filed on Sep. 4, 1992, now abandoned.

BACKGROUND OF THE INVENTION

The present invention relates to an automatic cutting machine for cutting sheet material such as knit cloth and woven cloth into a desired shape, and more particularly to a brush mounting structure for a cutting support surface in such an automatic cutting machine.

In a conventional automatic cutting machine, for example in the brush mounting table and brush for a cutting support surface as disclosed in the Japanese Laid-open Patent Hei. 3-26496, the brush can be moved by sliding on a groove in the longitudinal direction of the brush mounting table, and when mounting each brush on the brush mounting table or dismounting from the brush mounting table, the brushes are replaced by mounting each brush by sliding from the end of the brush mounting table, or by dismounting each brush from the end of the brush mounting table by moving in the longitudinal direction of the brush mounting table.

In such constitution of the brush mounting table and the brush for a cutting support surface in the prior art, it is possible to slide laterally on the brush mounting table, but not possible to detach or attach at that position. For example, if the brush for cutting support surface in the middle position of the cutting support surface formed by multiple brushes is damaged and that brush must be replaced, the other brushes must be also moved and once dismounted from the brush mounting table, and put back to the brush mounting table together with a new brush, and therefore the cutting job must be suspended in this period.

Or, in the case of brushes that can be detached and attached at specific positions without sliding the brush mounting table, a new brush is installed in that position. It means the bristles of the brush are renewed only in that position, so as to be extremely imbalanced from the worn state of the brush bristles existing in the surroundings. It was a problem from the viewpoint of maintaining a favorable cutting support surface by keeping uniform, to a certain extent, the worn state of the bristles.

The invention is devised in the light of such problems, and it is hence a primary object thereof to present a brush mounting structure for a cutting support surface in an automatic cutting machine capable of dismounting a desired brush out of the plural brushes for a cutting support surface disposed parallel on the brush mounting table for a cutting support surface, arbitrarily from the brush mounting table, and also laying parallel by filling up the gaps on the brush mounting table by feeding the slidable brushes forward.

SUMMARY OF THE INVENTION

The invention is composed as follows in order to achieve the above object effectively. More specifically, the invention presents a brush mounting structure for a cutting support surface in an automatic cutting machine, in which multiple brushes having ventilation holes are disposed on a brush mounting table for a cutting support surface having multiple ventilation holes to form a sheet material cutting support surface. A suction mechanism for sucking sheet materials stacked up on the cutting support surface is disposed beneath the brush mounting table, while a cutter device movable to a desired position is disposed above the cutting support surface, and sheet materials stacked up on the cutting support surface are cut to a desired shape by movement of the cutter device. The brushes for the cutting support surface possess ventilation holes, and also have multiple bristles in the upper part and have plural engaging protrusions in the lower part, and stopping protrusions capable of stopping and sliding detachably the engaging protrusions of the brushes for the cutting support surface are formed on the brush mounting table for the cutting support surface.

In this constitution, by installing the brushes so that the engaging protrusions of the brush for a cutting support surface may be engaged with the stopping protrusions of the brush mounting table for a cutting support surface, and by sliding on the brush mounting table, plural brushes are sequentially mounted on the brush mounting table, and the cutting support surface is formed by these multiple brushes mounted on the brush mounting table.

If the brush bristles are damaged by the cutting job, the damaged brush is lifted up so as to disengage the stopping state, and is dismounted from that position on the mounting table. By sliding the other brushes to fill up the gap, a new brush is stopped at the end of the brush mounting table, thereby avoiding the nonuniformity caused by placing a new brush in the place of the removed brush so that the bristles are fresh in that position only as compared with the worn bristles of the other brushes, and therefore the bristles of the plural brushes at frequent cutting positions may be almost uniform. Of course, a new brush may be put in the position of the damaged and removed brush.

BRIEF DESCRIPTION OF THE DRAWINGS

FIGS. 9 and 10 illustrate a single table with a new brush replaced at opposite ends of a table.

DETAILED DESCRIPTION OF THE PREFERRED EMBODIMENT

Figure 1:
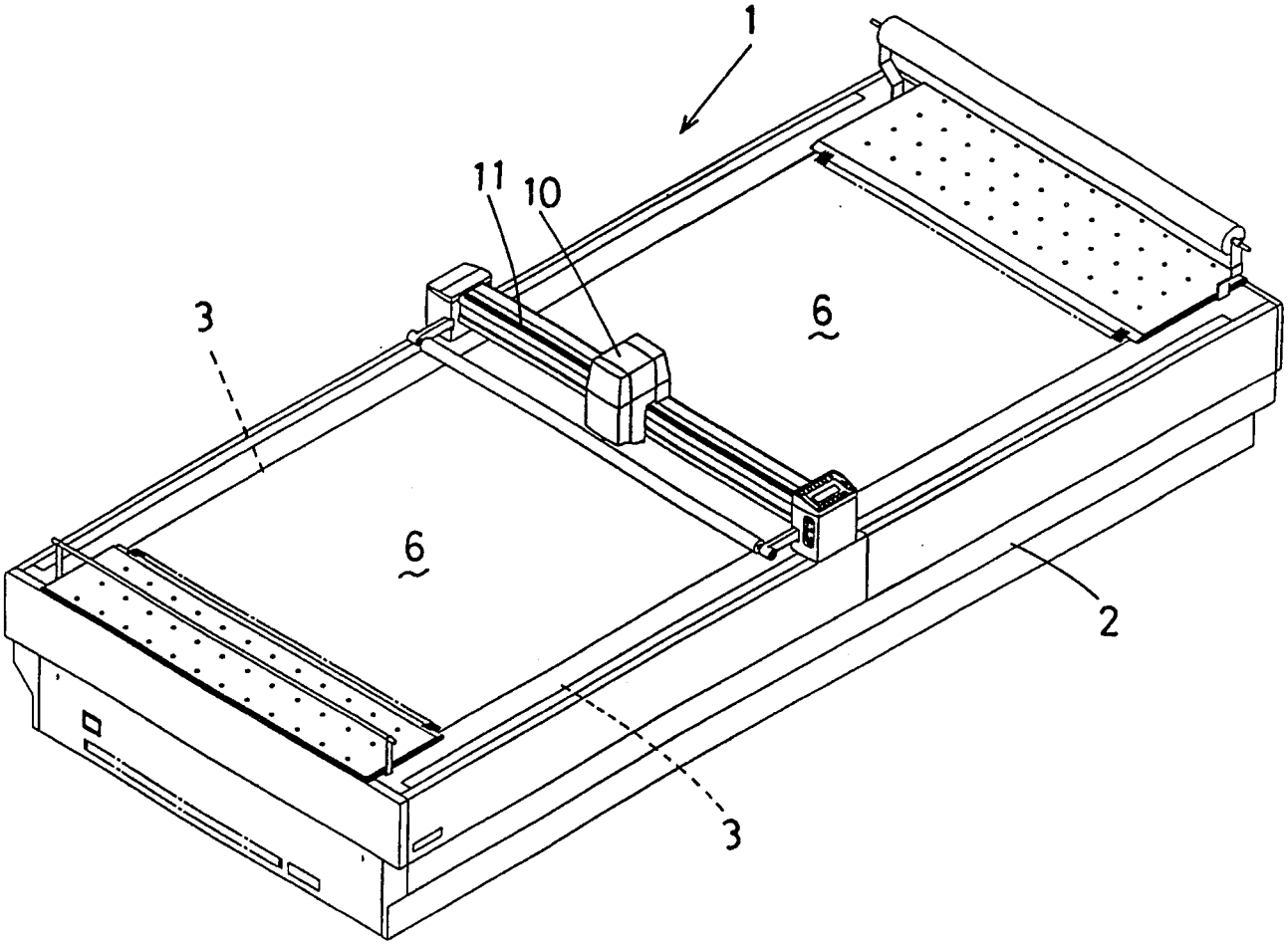
FIG. 1 is a perspective view of an automatic cutting machine in an embodiment of the invention.

An embodiment of the invention is described below by reference to FIG. 1 through FIG. 4.

Numeral 1 denotes an automatic cutting machine in one embodiment, and this automatic cutting machine 1 has endless chains 3 disposed at both sides of an automatic cutting machine main body 2, and multiple brush mounting tables 4 for the cutting support surface are suspended parallel to each other on these two endless chains 3. The brush mounting tables are moved by rotation of the endless chains 3 driven by a drive unit (not shown). Plural brushes 5 for the cutting support surface are disposed on the brush mounting tables 4 for providing a cutting support surface, and a cutting support surface 6 for stacking up sheet materials to be cut is formed by bristles 5a of brushes 5.

Furthermore, multiple ventilation holes 7 are pierced in the brush mounting tables 4 and brushes 5. A suction device (not shown) for sucking the sheet materials stacked up on the cutting support surface 6 is installed beneath the brush mounting table 4, and an elevating shielding plate 8 disposed elevatably along the front side or rear side of the brush mounting table 4 is elevated by an elevation device 9 disposed at a specified position at both sides of the upper part of the automatic cutting machine main body 2 when the endless chains 3 stop, and by this shielding plate 8, the plural brush mounting tables 4 having the brushes are set as one block, and the air is shut off at the front side and the rear side of the block. By actuating the suction device, the sheet materials stacked up on the cutting support surface 6 within the block are sucked and supported.

Thus, above the cutting support surface 6, a cutter device 10 movable in the lateral direction is supported and disposed on a lateral frame support 11 movable in the longitudinal direction. The cutter device 10 moves laterally on the lateral frame support 11 by a drive unit (not shown). The lateral frame support 11 is also designed to be moved by a drive unit (not shown) in the longitudinal direction on the cutting support surface 6. The cutter device 10 has a cutter blade moving vertically, and by the lateral move of the cutter device 10 and the longitudinal move of the lateral frame support 11, the cutter device 10 moves to a desired position on the cutting support surface 6, thereby cutting the sheet materials stacked up on the cutting support surface 6 in a desired shape.

In this composed automatic cutting machine 1, the brush mounting structure for the cutting support surface of the invention, and the constitution of the brush mounting table 4 for cutting support surface and brush 5 for the cutting support surface are described further below.

First, the brush mounting table 4 for the cutting support surface is an extended shape so that its both ends may be mounted on the endless chains 3 disposed at both side of the automatic cutting machine main body 2, and multiple ventilation holes 12 are pierced. In the upper longitudinal direction of the brush mounting table 4, multiple brushes 5 for the cutting support surface are stopped in two rows at specific intervals. Accordingly, stopping protrusions 13 shown in the drawing are formed to project upward at both sides, in the longitudinal direction, of each row 14. The stopping protrusions 13 have bumps 13*a* formed smoothly on the outer surface by bulging out. The lower center part of the both ends of the brush mounting table 4 is designed to be affixed to the attachment disposed at one link of the endless chain 3 by a stopping screw 15. Near both sides of the lower part of the both ends of the brush mounting table 4, auxiliary rollers 16 are attached to the lower surface of the mounting table 4 through brackets 17. The brush mounting tables 4 for the cutting support surface are disposed parallel to the attachments provided at the adjacent links of the endless chains 3.

Figure 2:
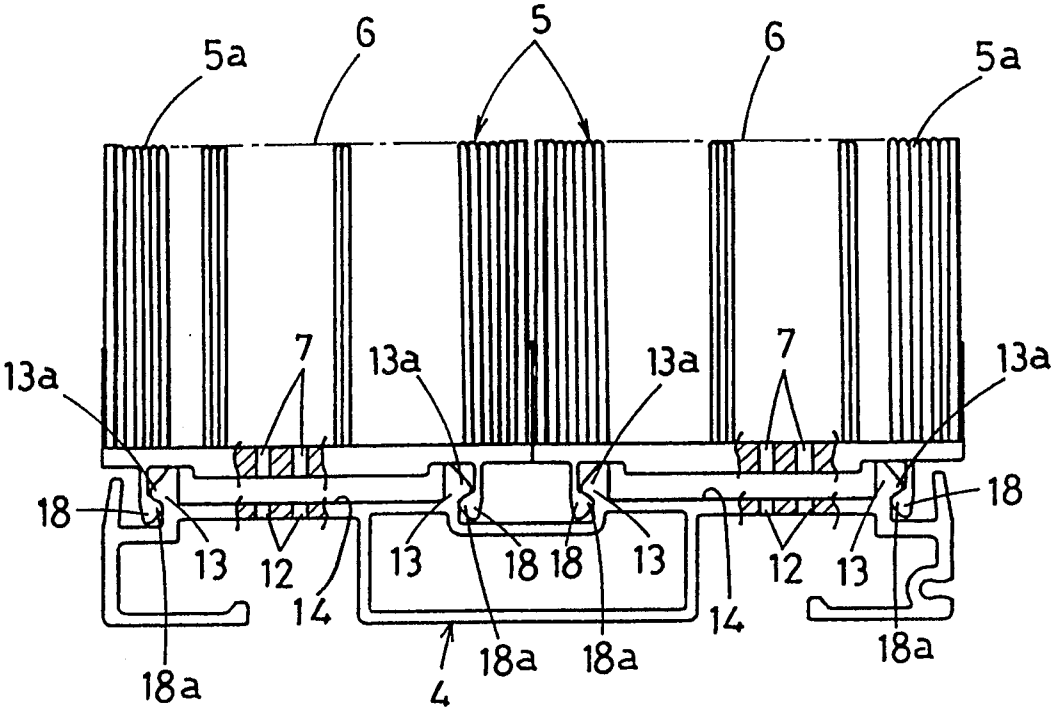
FIG. 2 is a partially cut-away side view showing the engaging relation of the brush mounting table for a cutting support surface and brush for cutting support surface in an embodiment of the invention.
Figure 3:
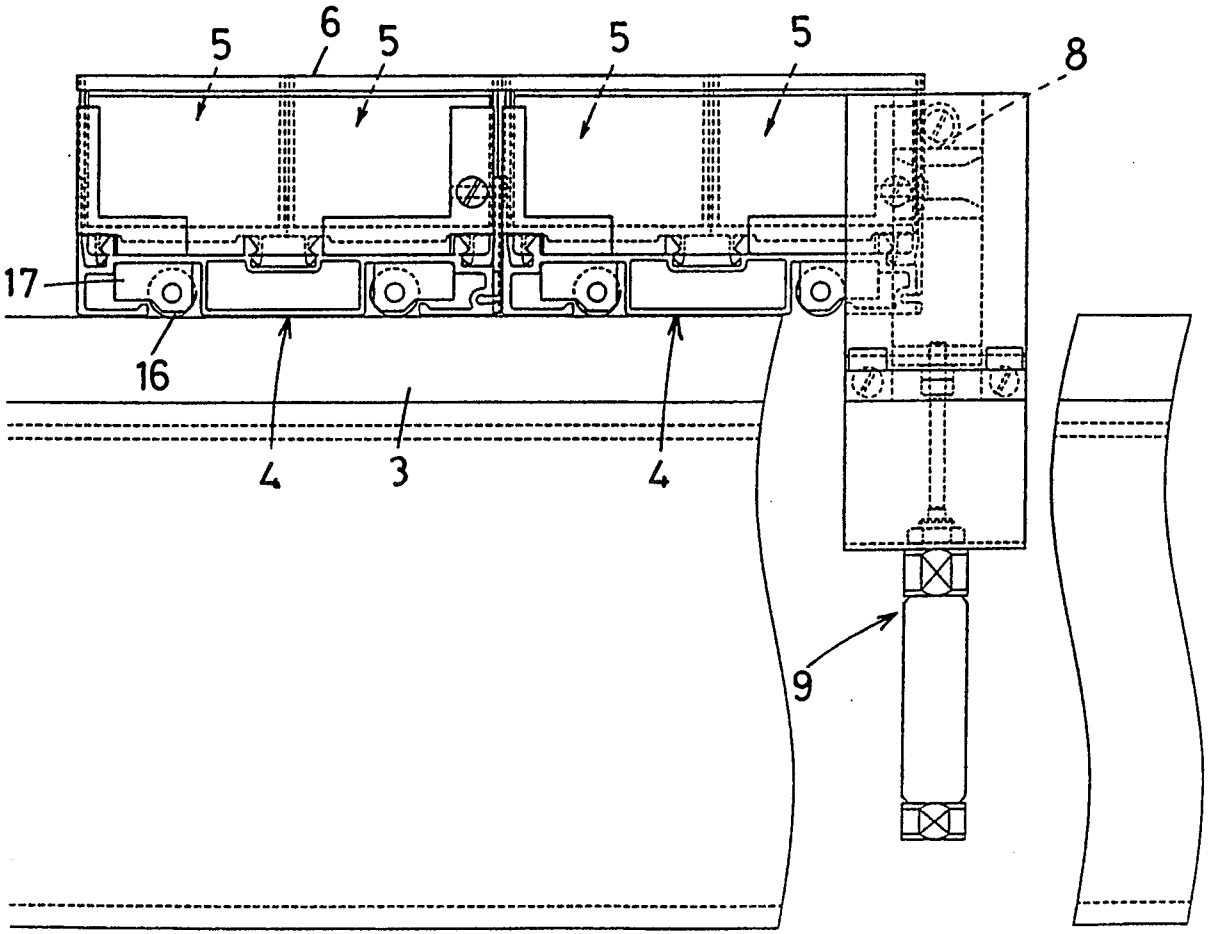
FIG. 3 is a side view of essential parts showing the configuration of the brush mounting table for a cutting support surface and brush for a cutting support surface in an automatic cutting machine.
Figure 4:
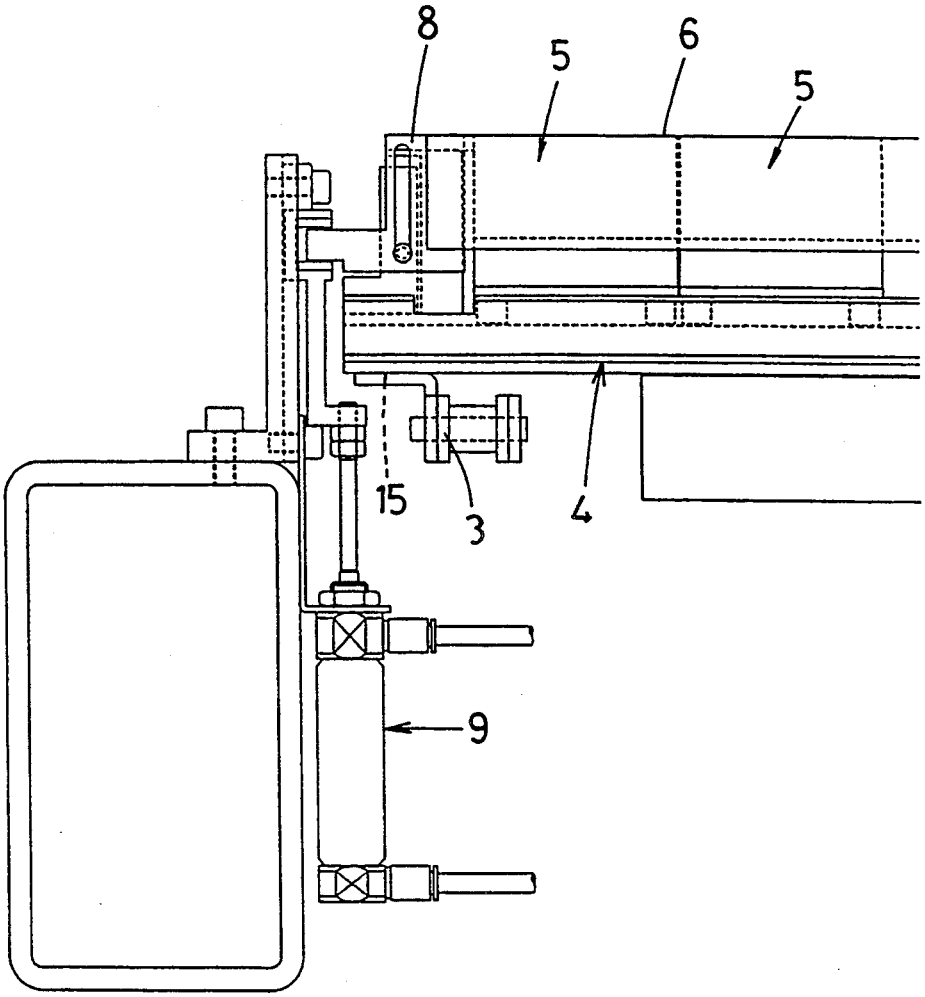
FIG. 4 is a front view of essential parts showing the configuration of the brush mounting table for a cutting support surface and brush for the cutting support surface in an automatic cutting machine.
Figure 5:
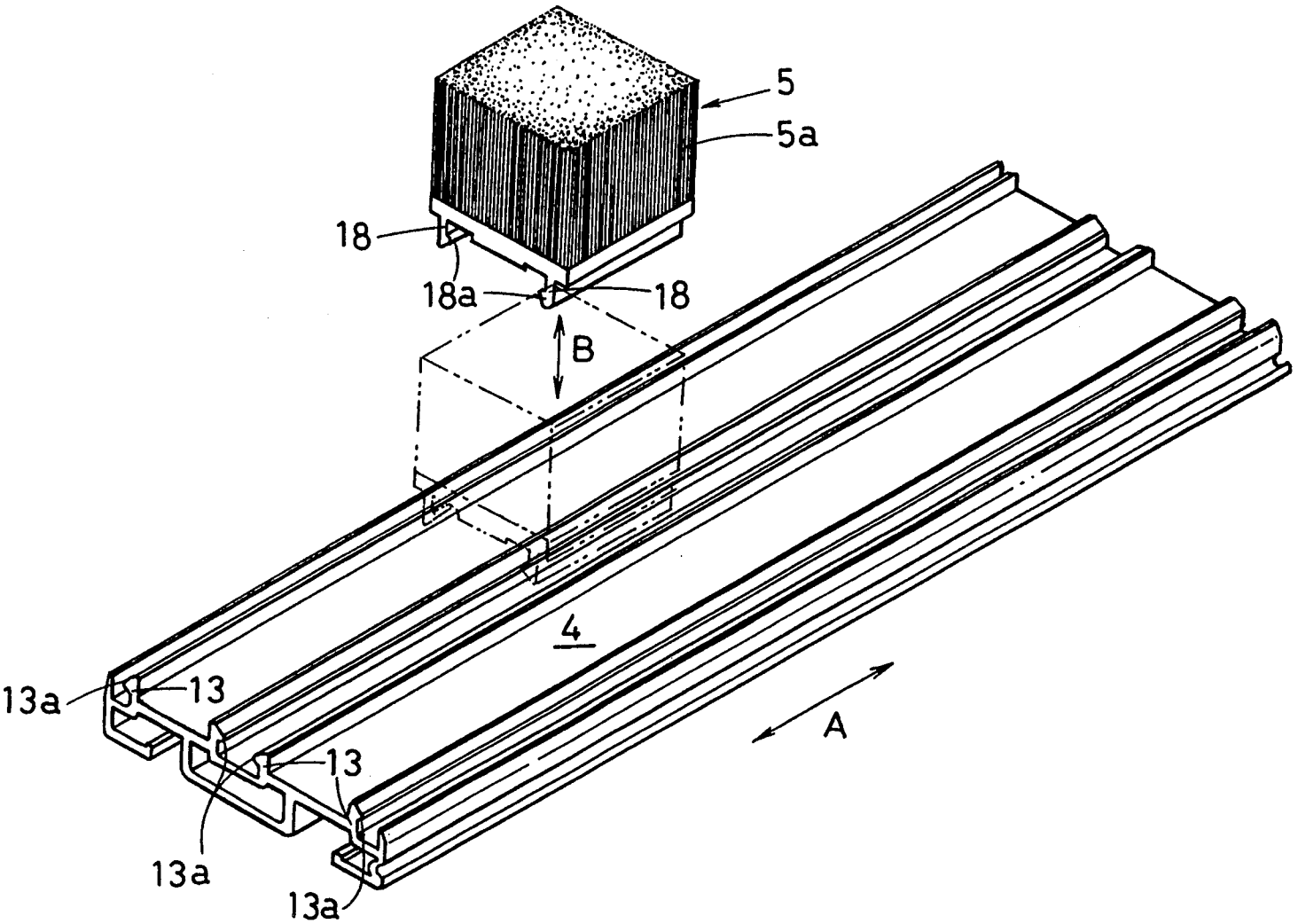
FIG. 5 illustrates one brush mounting table showing a length and width of the brush mounting table with one brush shown above the table with the brush attached shown in phantom.
Figure 6:
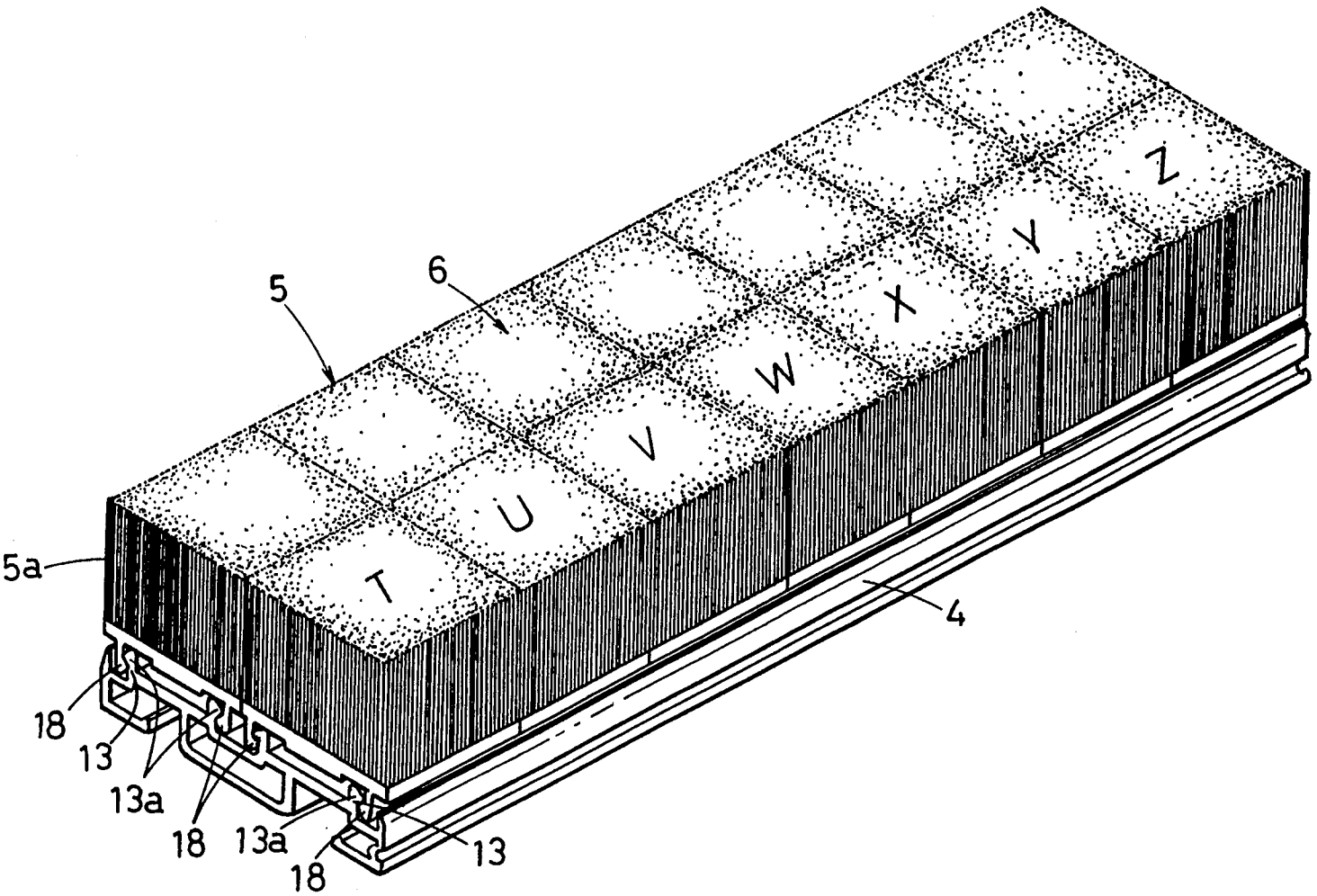
FIG. 6 illustrates a plurality of brushes mounted on a single table.
Figure 7:
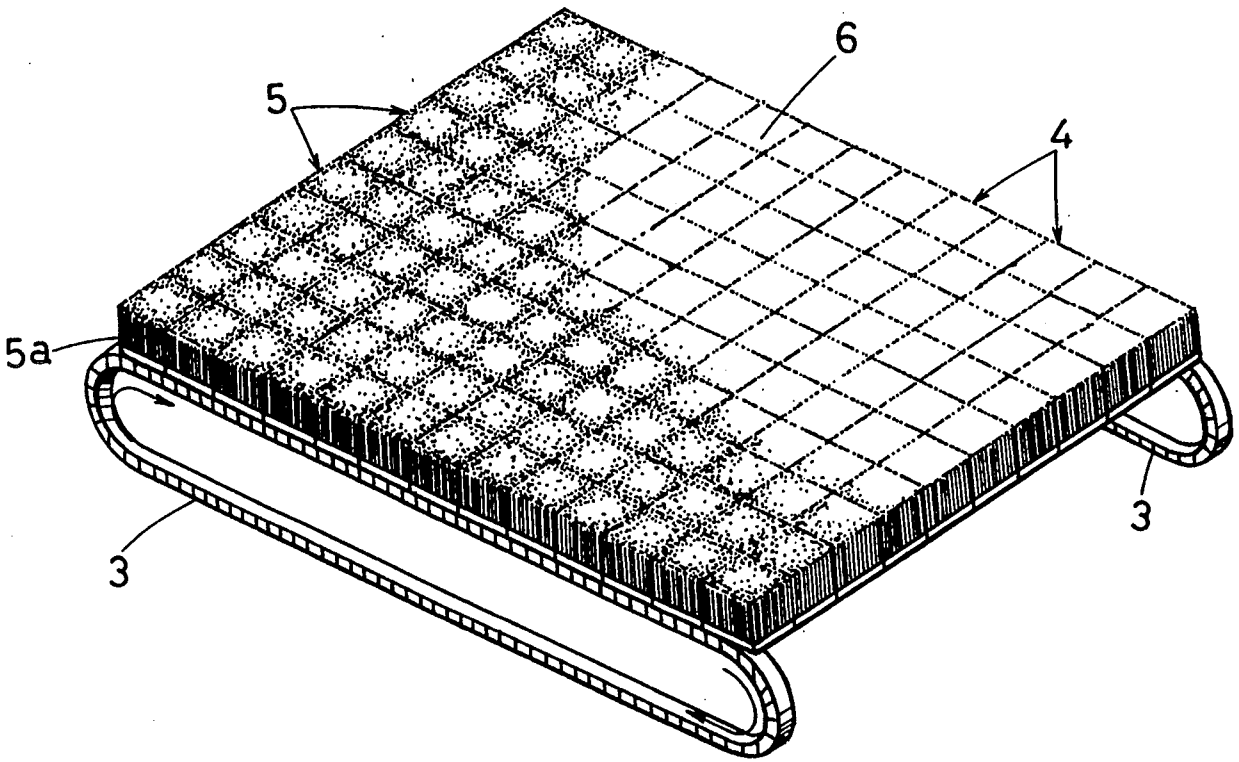
FIG. 7 illustrates a perspective view of a plurality of brushes assembled on a plurality of tables assembled on endless drive chains.
Figure 8:
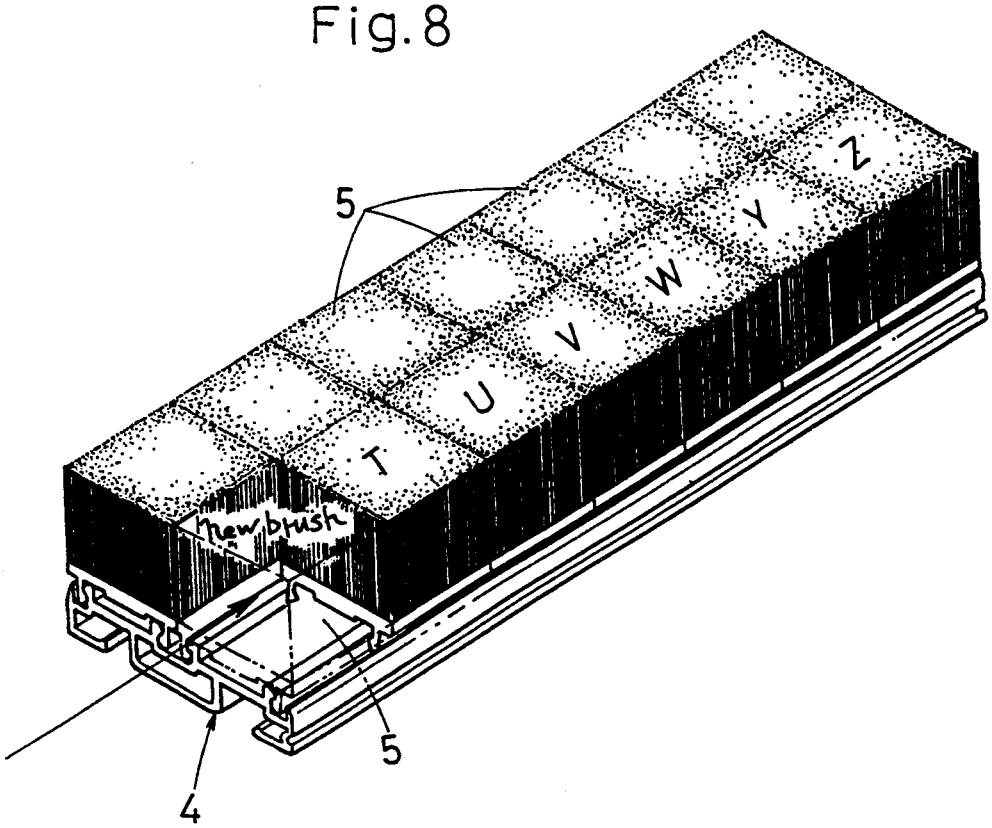
Figure 9:
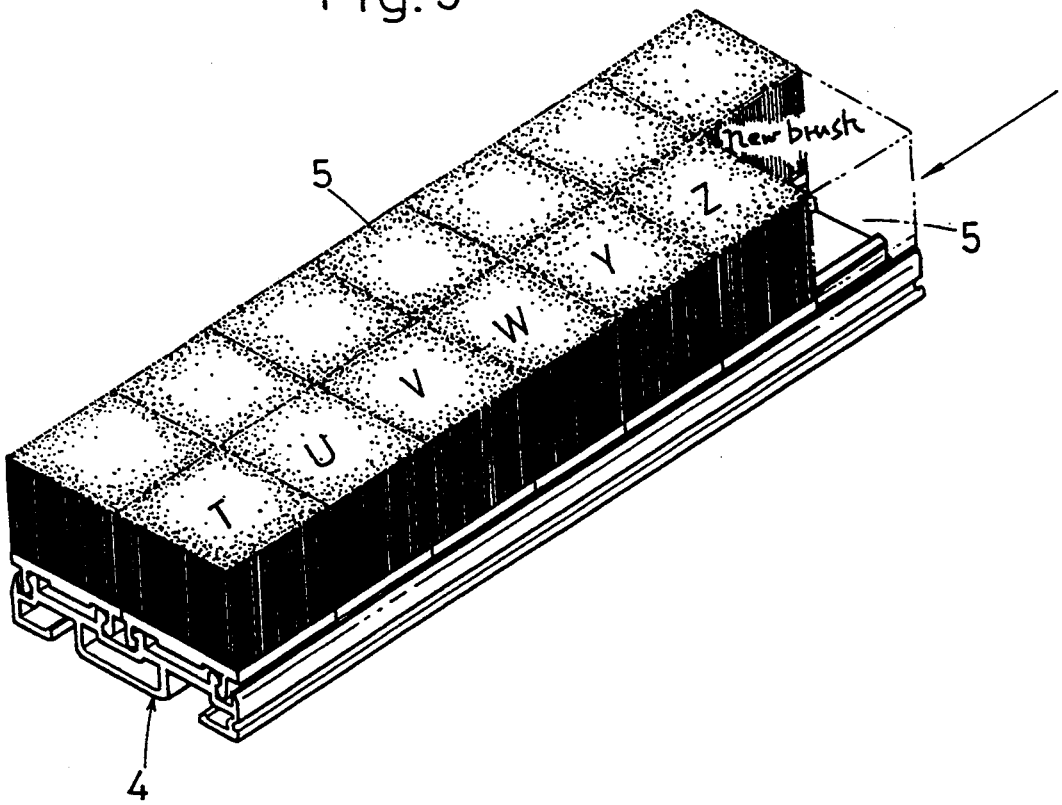

On the other hand, the brushes 5 for the cutting support surface mounted on the brush mounting tables 4 for the cutting support surface possess multiple ventilation holes 7 as shown in FIG. 2, and also possess multiple bristles 5*a* in the upper part, while, on the lower part, engaging protrusions 18 are detachably hooked on the bumps 13*a* of the stopping protrusions 13 of the brush mounting tables 4. The engaging protrusions 18 possess flexibility, and have bumps 18*a* with a smooth outer surface so as to be engaged with the lower part of the bumps 13*a* of the stopping protrusions 13. Accordingly, the bumps 13*a* of the stopping protrusions 13 of the brush mounting table 4, and the bumps 18*a* of the engaging protrusions 18 of the brushes 5 for the cutting support surface contact with each other smoothly on their abutting surfaces, so that the brushes 5 are allowed to slide on the brush mounting tables 4. Or by pulling upward on the brush 5, the flexible engaging protrusions 18 of the brush 5 are deflected along the bumps 13*a* of the stopping protrusions 13 of the brush mounting table 4, so that the the brush 5 is removed from brush mounting table 4.

Or, when mounting the brush 5 on the brush mounting table 4, by causing the engaging protrusions 18 of the brush 5 to be engaged from above with the stopping protrusions 13 of the brush mounting table 4, the flexible engaging protrusions 18 of the brush 5 are deflected along the bumps 13*a* of the stopping protrusions 13 of the brush mounting table, and finally the bumps 13*a* and bumps 18*a* are engaged with each other, so that the brush 5 is hooked on the brush mounting table 4.

By the brush mounting tables 4 for the cutting support surface and brushes 5 in the specified construction, the engaging protrusions 18 of the brushes 5 for the cutting support surface are engaged with the stopping protrusions 13 of each row abutting end to end at specified intervals of the brush mounting tables 4 of the cutting support surface, and by sequentially sliding in each row 14, the plural brushes for the cutting support surface are stopped. In this way, the cutting support surfaces are formed by the multiple brushes 5 mounted on the multiple brush mounting tables 4 for the cutting support surface disposed parallel on the endless chains 3.

In the course of such operation, if the bristles 5*a* of the brush 5 are damaged by the cutting operation, the damaged brush 5 is lifted up so as to be removed from the stopped state, and is dismounted from the mounting table 4. Then, sliding the other brushes 5, the brush gap of that row 14 on the brush mounting table 4 is filled up, and a new brush is installed by engaging with the end of the brush mounting table 4. In this way, the new brush 5 is not put in the position of the removed brush 5, but the existing brushes 5 are sequentially fed and moved, so that the state of damage is not so different from the damage of the bristles 5*a* of the surrounding brushes 5 after removing the damaged brush 5, avoiding the presence of fresh bristles 5*a* only in the replaced position, so that the state of damage of the bristles 5*a* of plural brushes at the frequent cutting positions (frequent brush replacing positions) may be almost uniform, The foregoing embodiment relates to an example of a so-called conveyor type automatic cutting machine having multiple brush mounting tables installed in parallel so as to be suspended on the endless chains, but the invention may be also applied to the so-called fixed type automatic cutting machine fixing multiple brush mounting tables parallel on the upper part of the frame. Or, in other possible construction, for example, using one large brush mounting table, the brush mounting table may be installed on the upper part of the frame of the automatic cutting machine main body, and multiple brushes may be mounted on the brush mounting table.

What is claimed is:

1. A brush mounting structure including a plurality of brush mounting tables, a plurality of brushes secured to each of said brush mounting tables to form a sheet material cutting surface in an automatic cutting machine in which:

each of said brush mounting tables include a lower portion which engages parallel endless drive chains upon which said brush mounting tables are mounted, each of said brush mounting tables include an upper portion which includes outwardly spaced protruding adjacent pairs of parallel rows of stopping protrusions (13) which extend along a length thereto in which each of said pairs of stopping protrusions face away from each other, each of said stopping protrusions (13) of each row is provided with oppositely facing first bumps **(13*a*) on an outer end thereof which face away from each other, each of said brushes (5) are provided with a lower part from which multiple bristles protrude outwardly, the lower part of each of said brushes includes a pair of supporting protrusions (18) which protrude in a direction opposite from said bristles, each of said pair of protrusions (18) are provided with second bumps (18*a*) that face each other and which interfit over the first bumps (13*a*) of a pair of the stopping protrusions of each said brush mounting table and are slidable along said pair of stopping protrusions (13) and said bumps (13*a*), each of said brushes removably engage said pair of stopping protrusions (13)** of each said brush mounting tables so that each of said brushes may be removed outwardly to disengage said brush from the pair of said stopping protrusions of said brush mounting tables whereby said removed brush can be replaced by a new brush forced onto said stopping protrusions of said brush mounting tables, further in order to have brushes of like wear side-by-side when a brush is removed, said brushes are slid from one end toward the non-removed brushes to replace the removed brush with a brush of like wear and the new brush is placed at an end of the row of brushes.

2. A brush mounting structure as set forth in claim 1, in which each of said brush mounting tables includes a plurality of first ventilation holes (12) between each stopping protrusion of each pair of protrusions and along a length of each said brush mounting table.

3. A brush mounting structure as set forth in claim 2, in which each brush includes a plurality of second ventilation holes (7) along a length of each brush.

4. A brush mounting structure as set forth in claim 1, in which each supporting protrusion of each pair of protrusions has a small connecting portion which is flexible for engagement and disengagement of said brushes with said pairs of stopping protrusions.

5. A brush mounting structure as set forth in claim 1, wherein one stopping protrusion of one pair of stopping protrusions is interconnected with a stopping protrusion of an adjacent pair of stopping protrusions with said first bumps **(13*a*)** facing each other.

6. A brush mounting structure as set forth in claim 1, in which one stopping protrusion (13) of one pair of protrusions and one stopping protrusion of an adjacent pair of protrusions are joined by a rigid connection which forms a somewhat U-shape with said adjacent protrusions of adjacent pairs of projecting stops.

* * * * *